US005970832A

United States Patent [19]

Aizawa

[11] Patent Number: 5,970,832

[45] **Date of Patent: *Oct. 26, 1999**

[54] TURRENT-TYPE PRESS MACHINE USING REPOSITIONING SYSTEM TO REDUCE OFFSET

[75] Inventor: Hideto Aizawa, Inuyama, Japan

[73] Assignee: Murata Kikai Kabushiki Kaisha, Kyoto, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/962,738

[22] Filed: Nov. 3, 1997

[30] Foreign Application Priority Data

Nov. 29, 1996 [JP] Japan ..... 8-334609

[51] Int. Cl.[6] ..... B23Q 1/26

[52] U.S. Cl. ..... 83/76.1; 83/277; 83/552

[58] Field of Search ..... 83/35, 36, 276, 83/277, 282, 552, 55, 58, 467.1, 468.6, 468.93, 451, 76.1

[56] References Cited

U.S. PATENT DOCUMENTS

| | | | |
|---|---|---|---|
| 44,871 | 11/1864 | Livermore | 83/277 |
| 2,309,998 | 2/1943 | Tucker | 83/552 |
| 3,377,887 | 4/1968 | Nelson et al. | 83/552 |
| 3,449,991 | 6/1969 | Daniels | 83/277 |
| 3,902,389 | 9/1975 | Brown et al. | 83/277 |
| 4,096,774 | 6/1978 | Kaufmann | 83/552 |
| 4,134,317 | 1/1979 | Goel et al. | 83/552 |
| 4,162,641 | 7/1979 | Stubbings | 83/552 |
| 4,486,941 | 12/1984 | Scott et al. | 83/552 |
| 4,658,682 | 4/1987 | Taijonlahti et al. | 83/13 |
| 4,658,688 | 4/1987 | Shah et al. | 83/552 |
| 5,342,276 | 8/1994 | Fujiwara et al. | 83/552 |

FOREIGN PATENT DOCUMENTS 7-164081 6/1995 Japan .

*Primary Examiner*—Rinaldi I. Rada
*Assistant Examiner*—Gyounghyun Bae
*Attorney, Agent, or Firm*—Armstrong, Westerman, Hattori, McLeLand & Naughton

[57] ABSTRACT

A press machine is provided to reliably reposition a workpiece without causing it to become offset. The press machine includes a punch tool for punching a workpiece and a workpiece gripping section for gripping and moving a workpiece on a table. The workpiece gripping section repositions the workpiece. A control facilities stops the punch tool while it is penetrating the workpiece during the punching operation. In this stopped condition, the control facilities causes the workpiece griping section to perform a repositioning operation. During the repositioning operation, the control facilities selects a punch tool with a shape other than a perfect circle to fix the workpiece.

3 Claims, 10 Drawing Sheets

TURRENT-TYPE PRESS MACHINE USING REPOSITIONING SYSTEM TO REDUCE OFFSET

FIELD OF THE INVENTION

The present invention relates to a press machine such as a turret-type punch press machine.

BACKGROUND OF THE INVENTION

In conventional turret-type punch press machines, a workpiece feeding apparatus for feeding a plate workpiece on a table to a punching position includes a workpiece holder that is moved while gripping a workpiece.

A condition such as the size of a workpiece or a punching position on the workpiece may require the workpiece feeding apparatus to perform a repositioning operation for repositioning the workpiece to change the gripping position of the workpiece holder. During such a repositioning operation, since the workpiece may become offset if it is slightly released from the workpiece holder, a pair of friction pads that can be elevated and lowered by an elevating cylinder are provided and used to press the workpiece against the table to prevent such offset.

When the frictional force of the friction pads is used to fix the workpiece against the table as described above, the workpiece is not properly fixed and can get offset while being re-gripped by the workpiece holder.

The present invention is designed to solve the above-described problem and to provide a press machine capable of reliably repositioning the workpiece without causing it to be offset.

SUMMARY OF THE INVENTION

A press machine according to the present invention comprises: a workpiece gripping section for gripping and moving a workpiece on a table, the workpiece gripping section being capable of a repositioning operation in which a workpiece is repositioned; a punch tool for punching a hole in a workpiece; and a control means for stopping the punch tool while it is penetrating a workpiece during a drilling operation and causing the workpiece gripping means to perform a repositioning operation in this stopped condition.

Since this configuration allows the workpiece gripping section to reposition the workpiece while the punch tool is penetrating the workpiece during a punching operation, the punch tool acts as a means for restricting the position of the workpiece in order to prevent it from becoming offset during a repositioning operation. In addition, the need to provide a position restricting member, such as pads, is not required to ensure a simpler configuration.

During a repositioning operation, the control means may select a punch tool with a shape other than a perfect circle to fix the workpiece. This configuration restricts not only the horizontal offset of the workpiece, but also its rotational offset around the punch tool, thereby more reliably preventing the workpiece from becoming offset during a repositioning operation.

In this configuration, friction pads for pressing the workpiece against the table may additionally be provided so that the workpiece is fixed using both the punch tool penetrating the workpiece and the friction pads. This configuration allows not only the punch tool penetrating the workpiece, but also the friction pads, to restrict the position of the workpiece, thereby more reliably preventing the workpiece from becoming offset during a repositioning operation. In this case, the rotational offset of the workpiece around the punch tool can also be prevented by the friction pads and by using a punch tool shaped like a perfect circle to fix the workpiece.

BRIEF DESCRIPTION OF THE DRAWING FIGURES

DETAILED DESCRIPTION OF THE PREFERRED EMBODIMENTS

Figure 1:
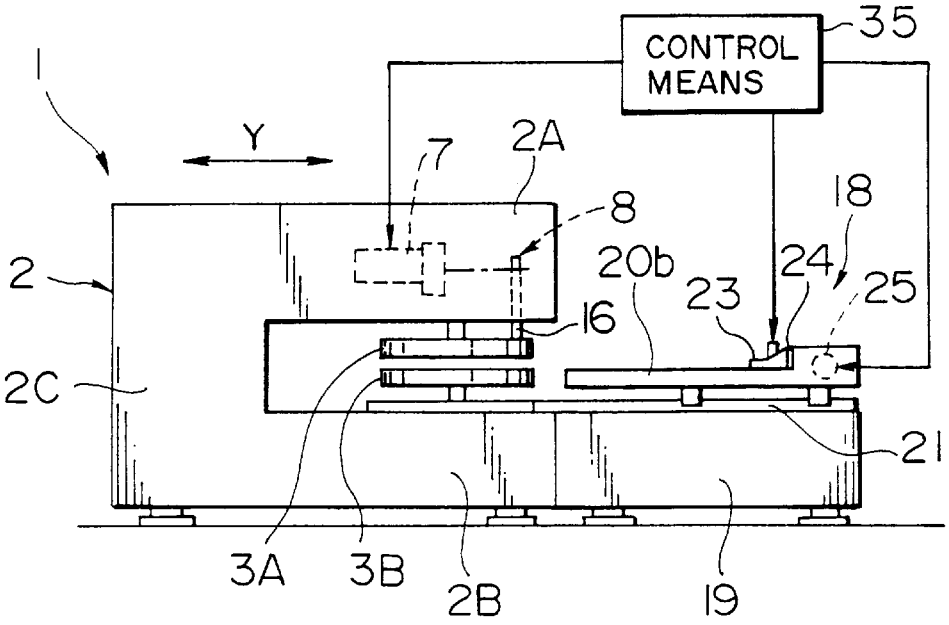
FIG. 1 is a conceptual drawing of a press machine according to a first embodiment of the present invention.
Figure 2:
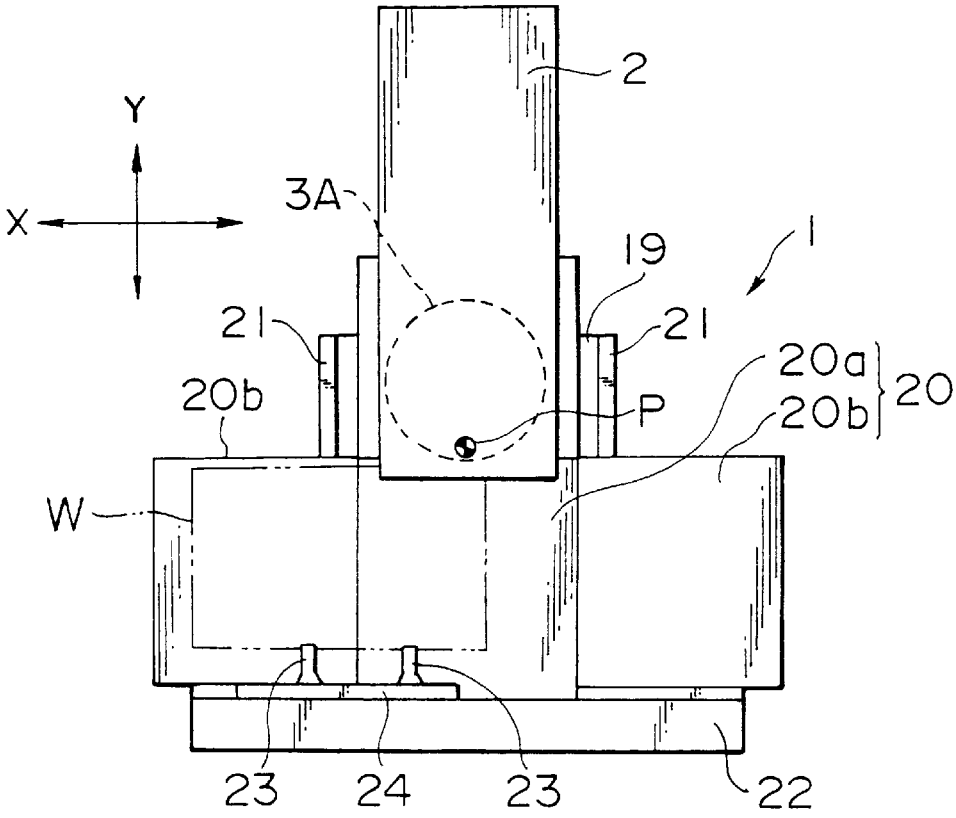
FIG. 2 is a plan view of the press machine.
Figure 3:
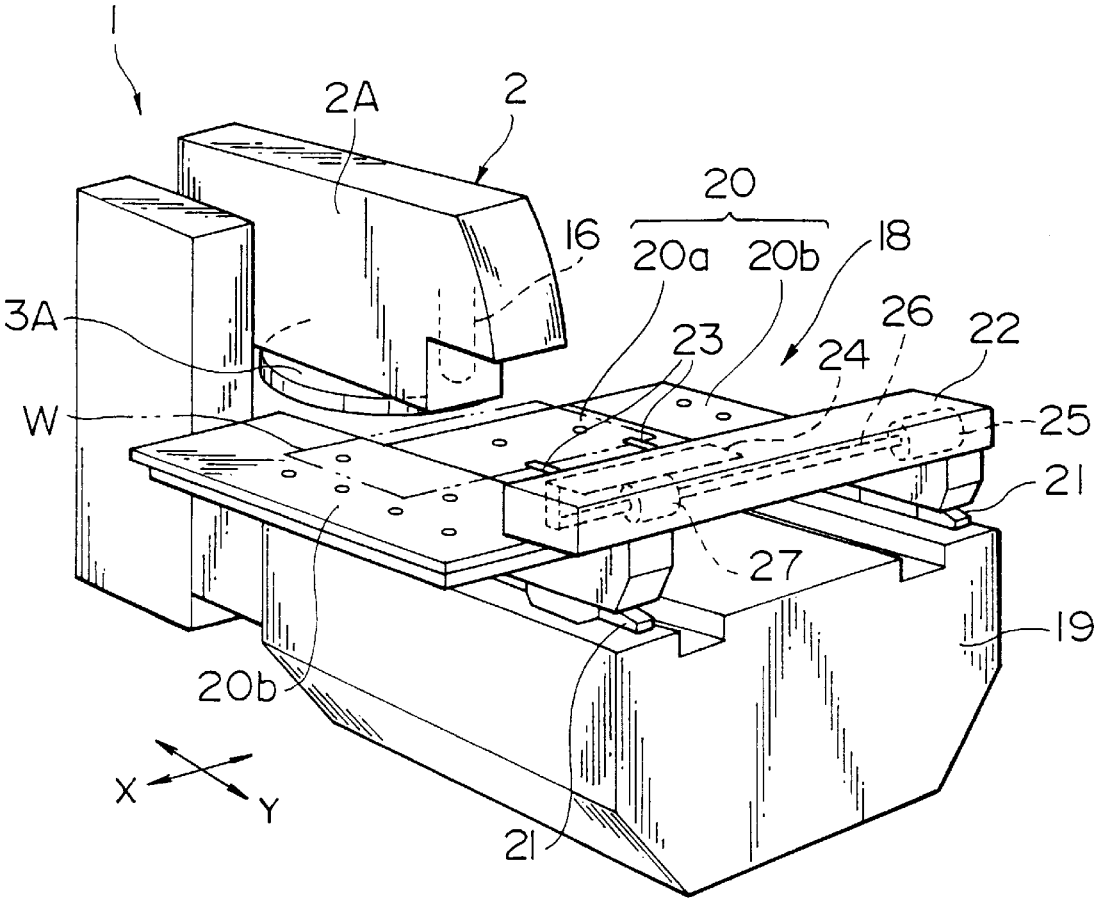
FIG. 3 is a perspective view of the press machine.

A first embodiment of the present invention is described with reference to FIGS. 1 to 8. FIG. 1 is a conceptual drawing showing a press machine according to the first embodiment. FIG. 2 is a plan view of the press machine of FIG. 1 and FIG. 3 is a perspective view of the press machine of FIG. 1.

Figure 5:
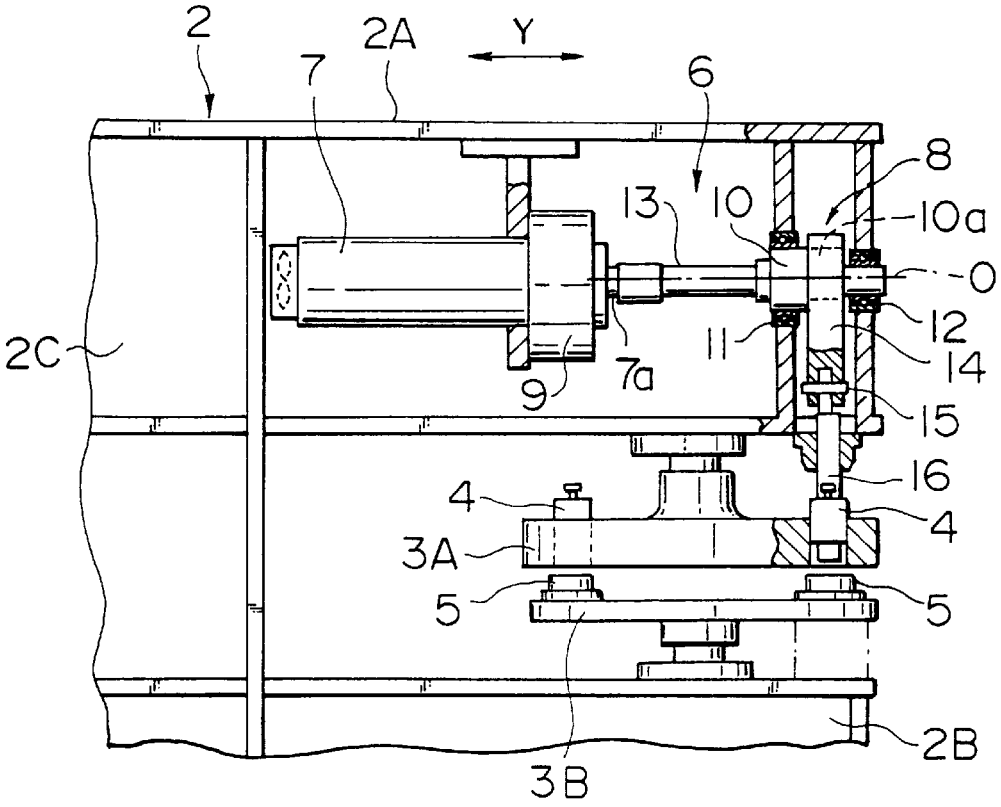
FIG. 5 is a vertical cross-sectional view showing a punch driving device installation portion of the press machine.
Figure 6:
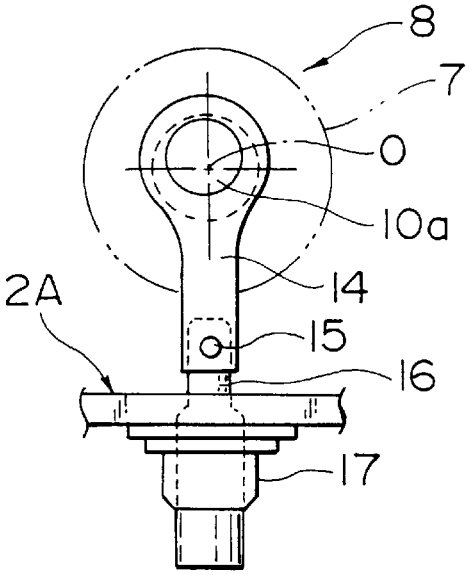
FIG. 6 is a front view of a conversion mechanism in the punch driving device.

A press machine 1 is a turret-type punch press machine of which a frame 2 comprises an upper frame section 2A, a lower frame section 2B and a pillar section 2C, each having a cross-section like a box. The frame 2 has a C-shaped side shape. Upper and lower turrets 3A and 3B are disposed in the space between the upper and lower frame sections 2A an 2B of the frame 2 and are rotatably supported by the upper and lower frame sections 2A and 2B, respectively. A plurality of press molds 4, constituting a punch tool, are installed on the circumference of the upper turret 3A, while a plurality of die molds 5 are installed on the circumference of the lower turret 3B (FIG. 5). The upper and lower turrets 3A and 3B are indexed and rotated by a turret driving device (not shown in the drawing figures) on the frame 2.

A punch driving device 6 for the press molds 4 is composed of a servo-motor 7 installed on the upper frame section 2A and a conversion mechanism 8 for converting the rotation of the servo-motor 7 into linear reciprocating motion in the vertical direction, as shown in the vertical cross-sectional view of FIG. 5. The servo-motor 7 has a built-in speed reducer 9 at one end and is accommodated in the upper frame 2A along a longitudinal direction Y.

The conversion mechanism 8 consists of an eccentric cam mechanism and an eccentric cam 10 is rotatably supported by a pair of bearings 11 and 12 at one end of the upper frame section 2A on the same rotational center 0 as a motor shaft 7*a* of the servo-motor 7 are connected together via a rotating shaft 13. The eccentric cam 10 has its eccentric shaft section 10*a* rotatably fitted via a bearing (not shown in the drawing figures) in a hole at the upper end of a crank arm 14. A ram 16 is coupled to the lower end of the crank arm 14 via a pin 15 and supported by a ram guide 17 provided at one end of the upper frame section 2A on its bottom surface so that it can be elevated and lowered. A T-shaped head coupling section, that is coupled to the head of the press mold 4 held in the upper turret 3A, is provided at one end of the ram 16.

A table device 18 is provided in front of the frame 2. The table device 18 comprises a workpiece table 20 consisting of a middle fixed table 20*a* provided on a bed 19 and a movable table 20*b* disposed on both sides of the fixed table 20*a*. The movable table 20*b* is moved back and forth (in direction Y) on a rail 21 on the bed 19 along with a carriage 22. The carriage 22 has a cross slide 24, having a workpiece holder 23, and is installed so as to be moved laterally (in direction X). A plate workpiece W, gripped by the workpiece holder 23, is fed in direction X, Y relative to the position P of the ram 16, when the carriage 22 is driven via a feed screw 26 and a ball nut 27 by the servo-motor 25 provided in the carriage 22 (FIG 3).

Figure 4:
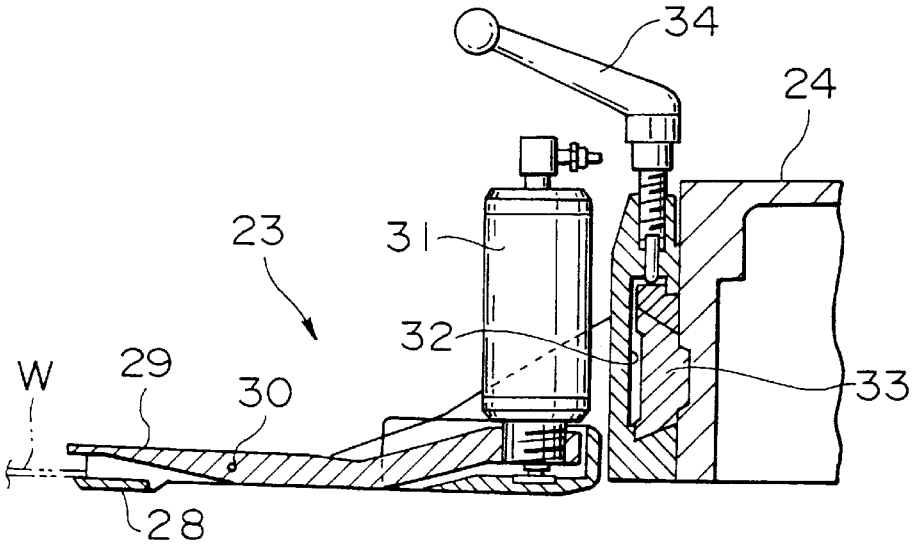
FIG. 4 is a cross-sectional view of a workpiece holder in the press machine.

As shown in FIG. 4, the workpiece holder 23 comprises an upper movable jaw 29 coupled to a lower fixed jaw 28 in such a way that the upper movable jaw 29 can be rotatably opened and closed around a supporting shaft 30. The plate workpiece W is gripped by the ends of both jaws 28 and 29. The upper movable jaw 29 is opened and closed by an air cylinder 31 mounted on its proximal end. The workpiece holder 23 is supported on the cross slide 24, and the workpiece holder 23 to enable lateral movement when a groove 32, formed in its rear surface, engages with a mounting rail 33 on the front surface of the cross slide 24, and the workpiece holder 23 is fixed in an arbitrary position by a tightening device 34.

Figure 8:
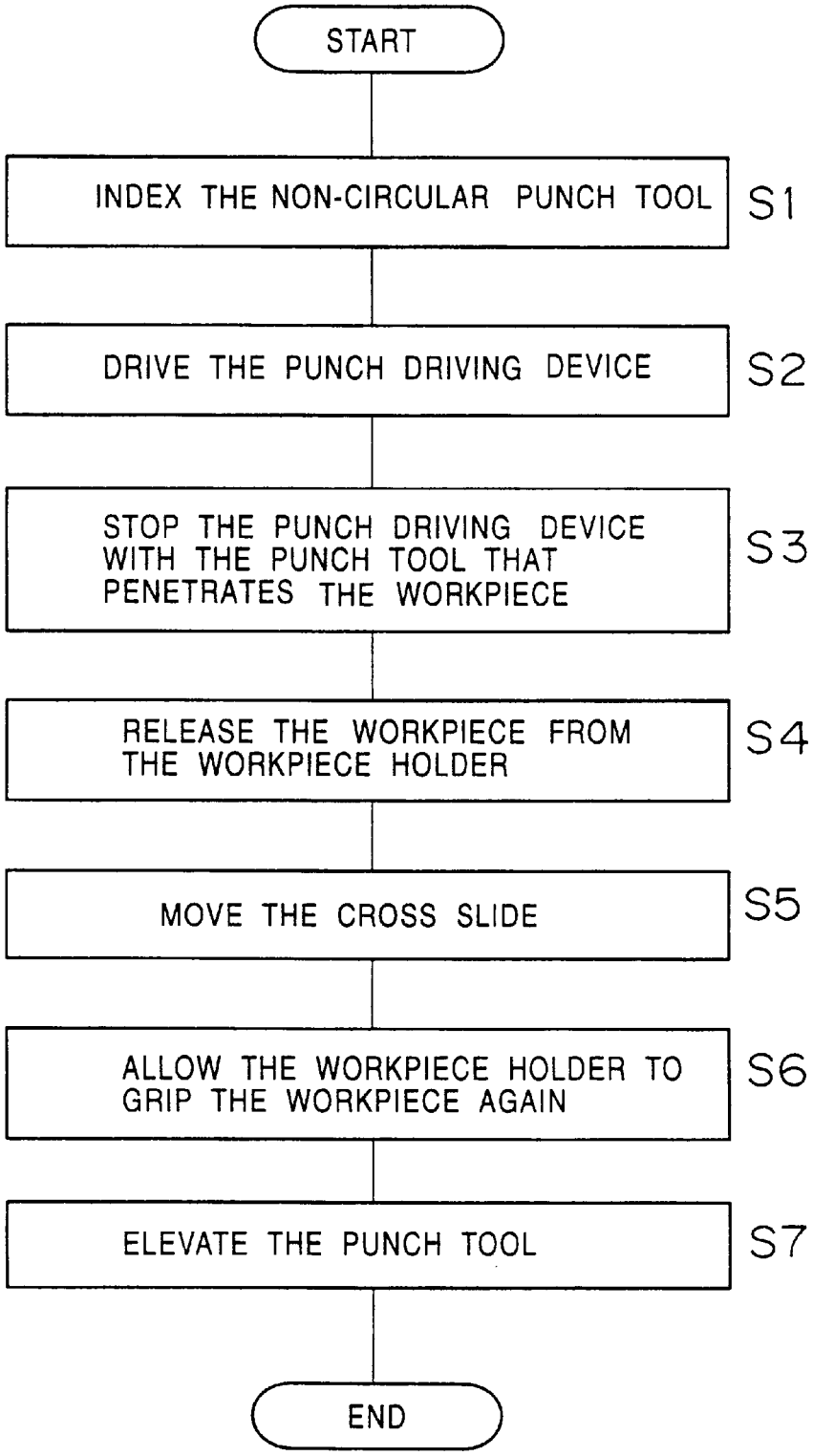
FIG. 8 is a control flow chart of the workpiece repositioning operation.

A control means 35 (FIG. 1) controls the entire operation of the press machine 1. The control means 35 also controls a repositioning operation in which the workpiece holder 23, acting as a workpiece griping section, repositions the plate workpiece W on the workpiece table 20. FIG. 8 shows a flow chart describing the control of the repositioning operation.

The repositioning operation controlled by the control means 35 is described with reference to FIG. 8. Prior to the repositioning operation, a punch tool with a horizontal cross-sectional shape of a rectangle of similar, other than a perfect circle, is indexed as the press molds 4 (step S1) and the punch driving device 6 is driven to punch the plate workpiece W (step S2). The punching operation can be used not only as part of the processing of the workpiece W, but also solely for a repositioning operation, wherein processing is not required.

Next, once the ram 16 has reached a bottom dead center and the press molds 4 have penetrated the plate workpiece W, the driving, by the punching driving device 6, is stopped (step S3). In this case, since the driving source of the punch driving device 6 consists of the servo-motor 7, control, such as the punch driving device 6 being stopped with the punch molds 4 penetrating the plate workpiece W is released from the workpiece holder 23, the punch molds 4 penetrating the plate workpiece W act as a position restraining member to restrict the plate workpiece W without horizontal or rotational offset.

Figure 7A:
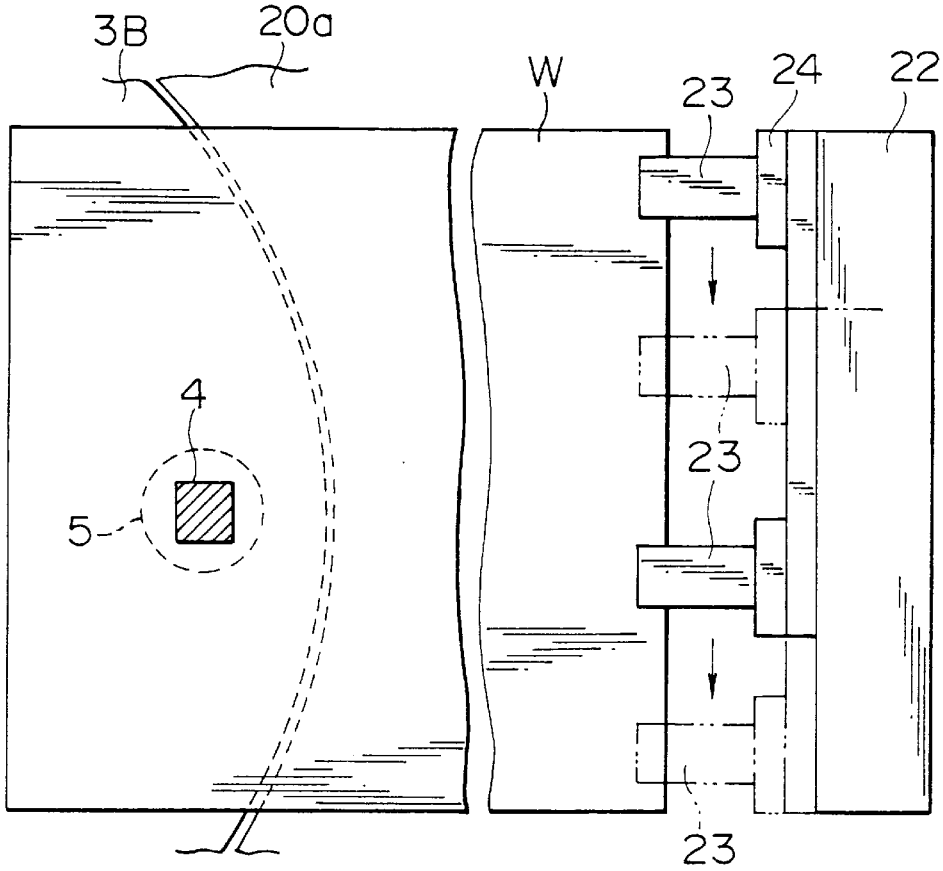
FIG. 7A is a plan view showing the workpiece repositioning operation.
Figure 7B:
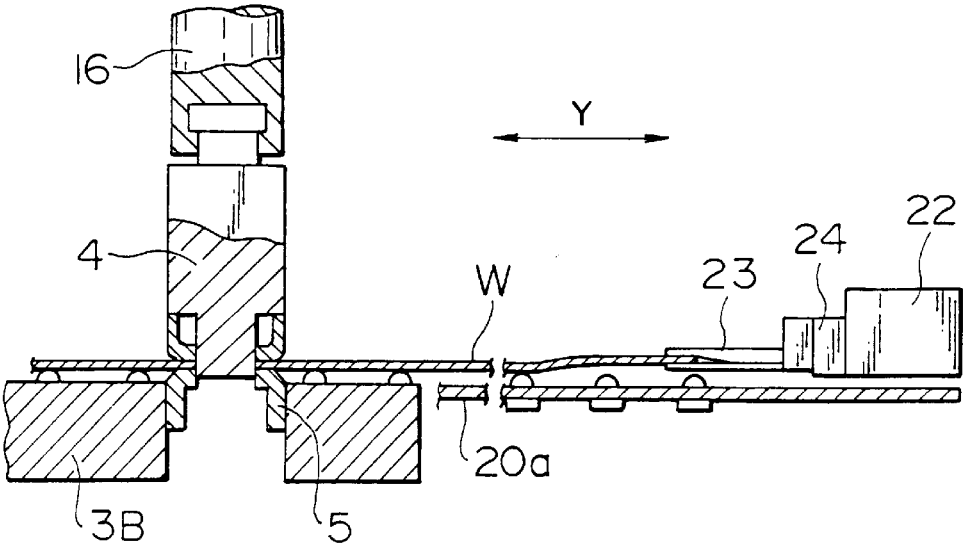
FIG. 7B is a vertical cross-sectional view showing this operation.

In this condition, after the plate workpiece W has been released from the workpiece holder 23 (step S4), the cross slide 24 is moved laterally as shown by the dotted line in FIG. 7A (step S5) and the plate workpiece W is then gripped again by the workpiece holder 23 (step S6). The press molds 4 are subsequently elevated (step S7). This workpiece repositioning apparatus therefore allows the workpiece holder 23 to reposition the plate workpiece W without the use of position restricting members such as pads, which press the plate workpiece W against the workpiece table 29, and without causing the plate workpiece W to become offset. This enables simple application to existing press machines.

Figure 9:
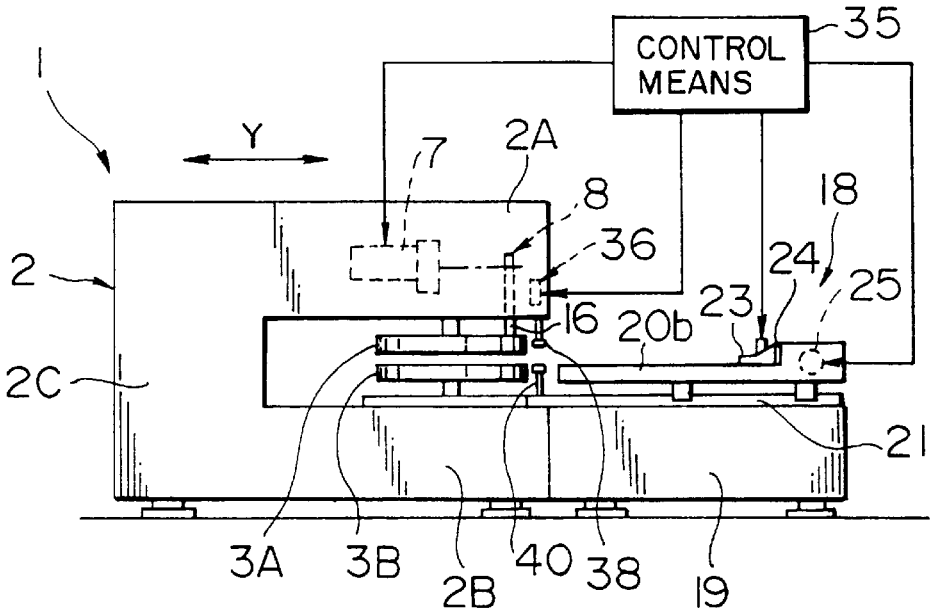
FIG. 9 is a conceptual drawing of a press machine according to a second embodiment of the present invention.
Figure 10:
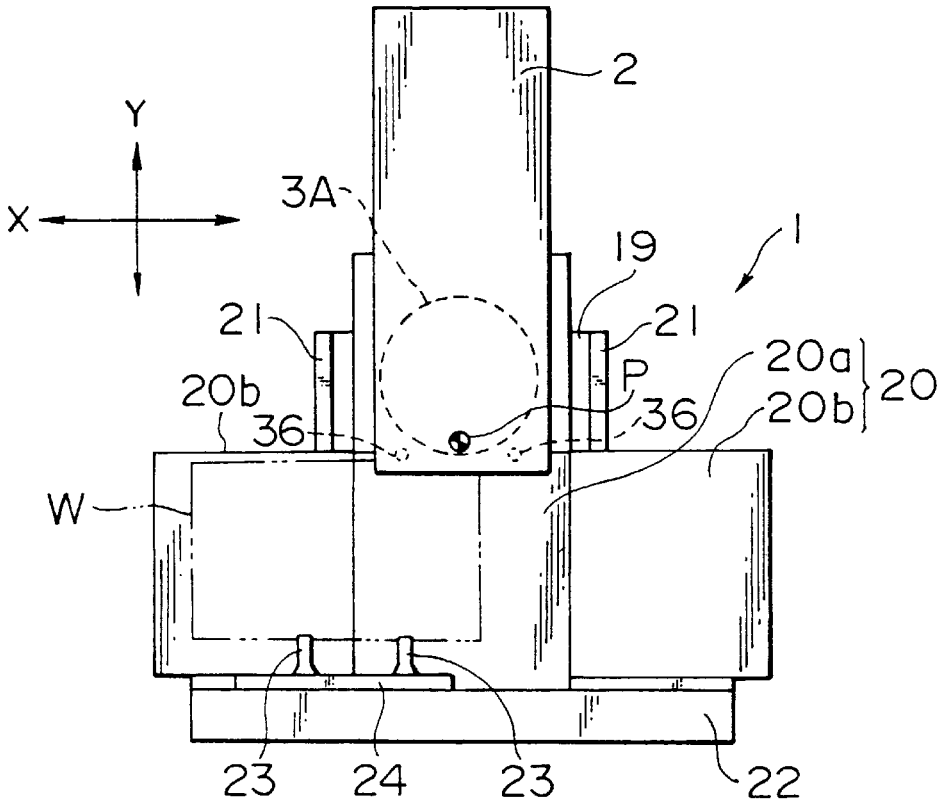
FIG. 10 is a plan view of the press machine of FIG. 9.
Figure 11:
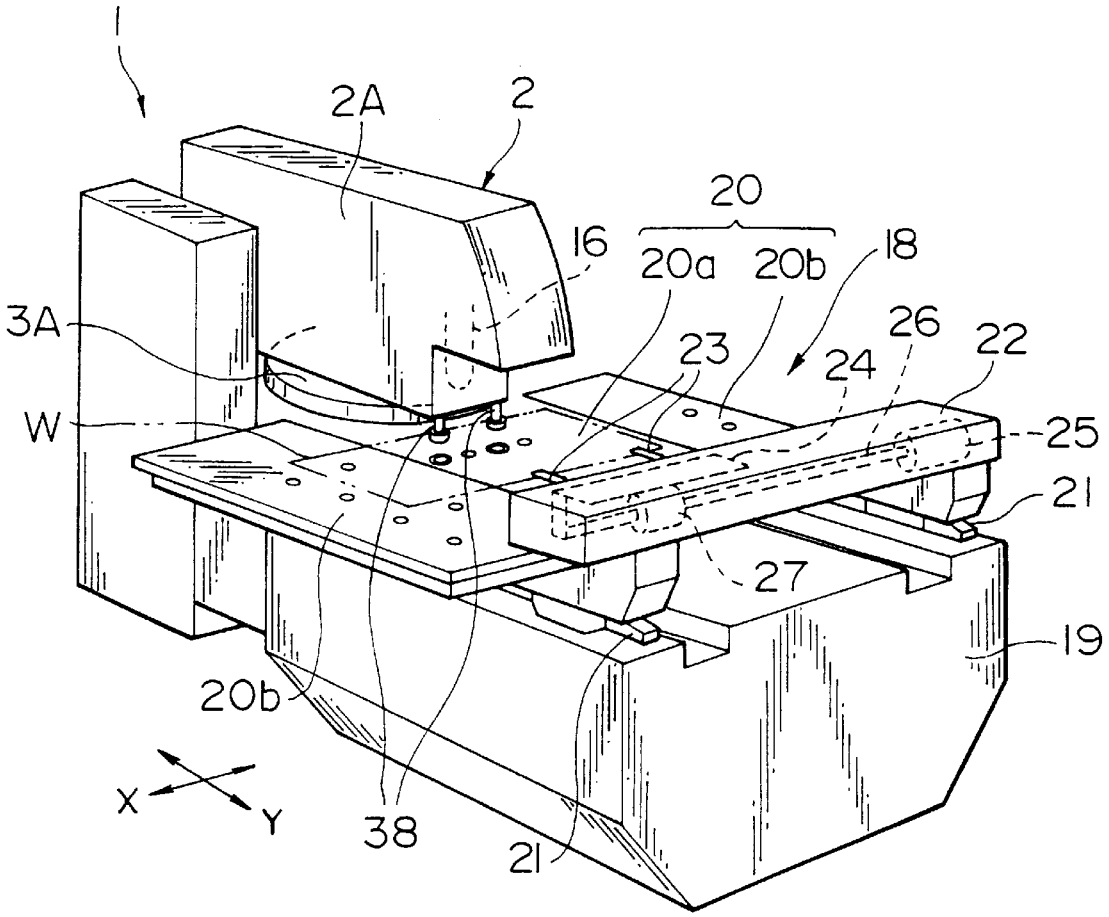
FIG. 11 is a perspective view of the press machine of FIG. 9.

FIG. 9 is a conceptual drawing of a press machine according to a second embodiment. FIG. 10 is a plan view of the press machine of FIG. 9. FIG. 11 is a perspective view of the press machine of FIG. 9.

Figure 12:
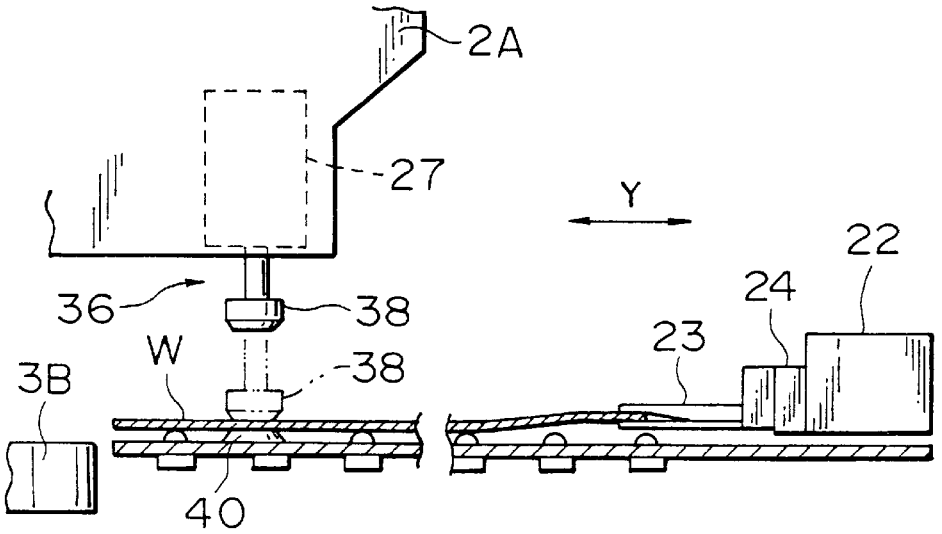
FIG. 12 is a side view showing a presser device installation portion of the press machine of FIG. 9.
Figure 13A:
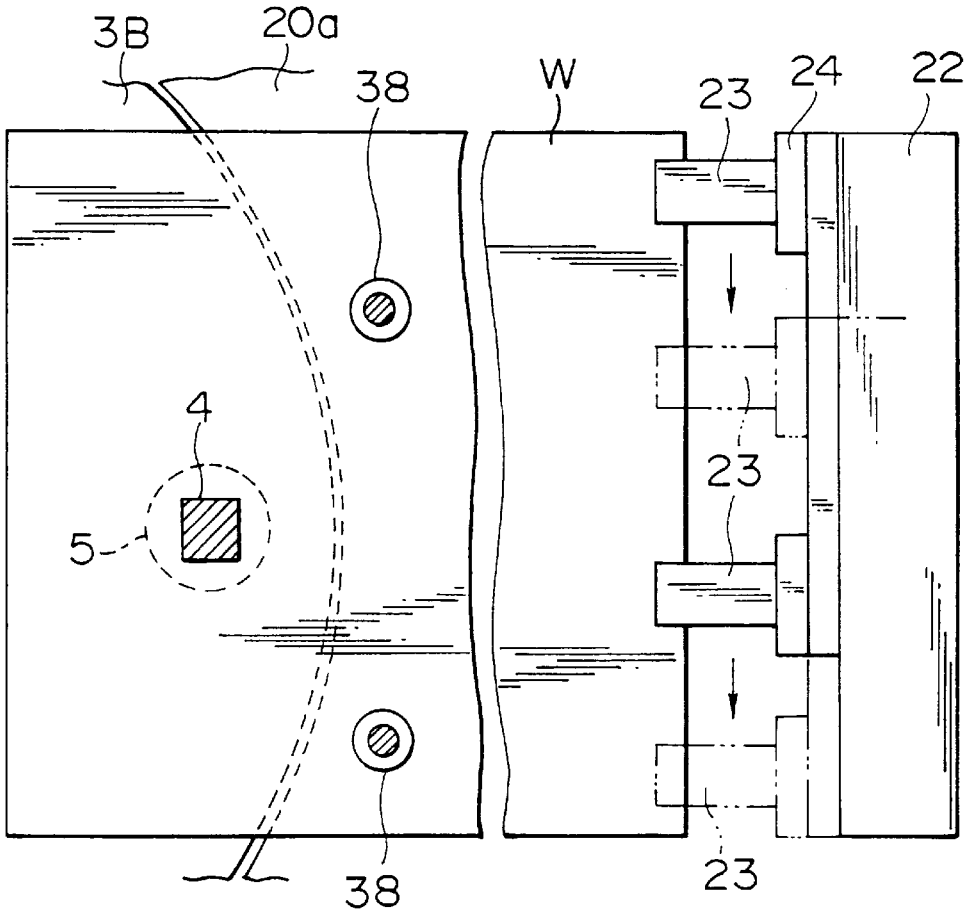
FIG. 13A is a plan view showing the workpiece repositioning operation with respect to the second embodiment.
Figure 13B:
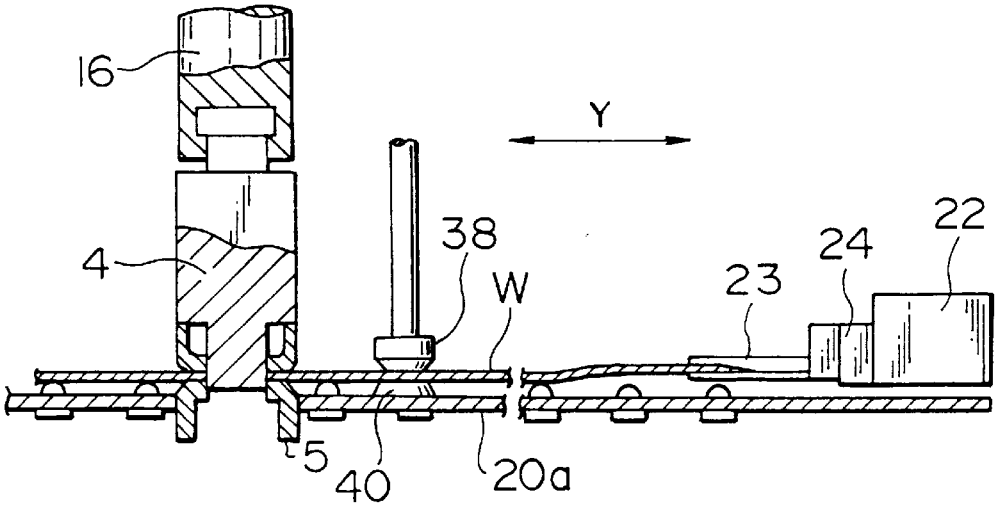
FIG. 13B is a vertical cross-sectional view showing this operation.

The second embodiment includes a presser device 36 which is located in the front of the upper frame section 2A of the press machine 1, which presses the plate workpiece W and, which can be elevated and lowered. The presser device 36 consists of an elevating cylinder 37 that is a driving source and friction pads 38 provided at one end of an elevating rod, as shown in FIG. 12. When the control means 35 controls the repositioning operation, the friction pads 38 are lowered to press the plate workpiece W against the workpiece table 20 while the press molds 4 penetrate the plate workpiece W.

It is preferred that friction pads 40, located under the friction pads 38 so as to oppose the friction pads 40, be provided on the workpiece table 20 or the frame 2 to allow the upper and lower friction pads 38 and 40 to hold the plate workpiece W. The lower pads 40 may be fixed or may be elevated and lowered by a driving source such as the elevating cylinder 41, as shown in the fourth embodiment of FIG. 16.

Figure 16:
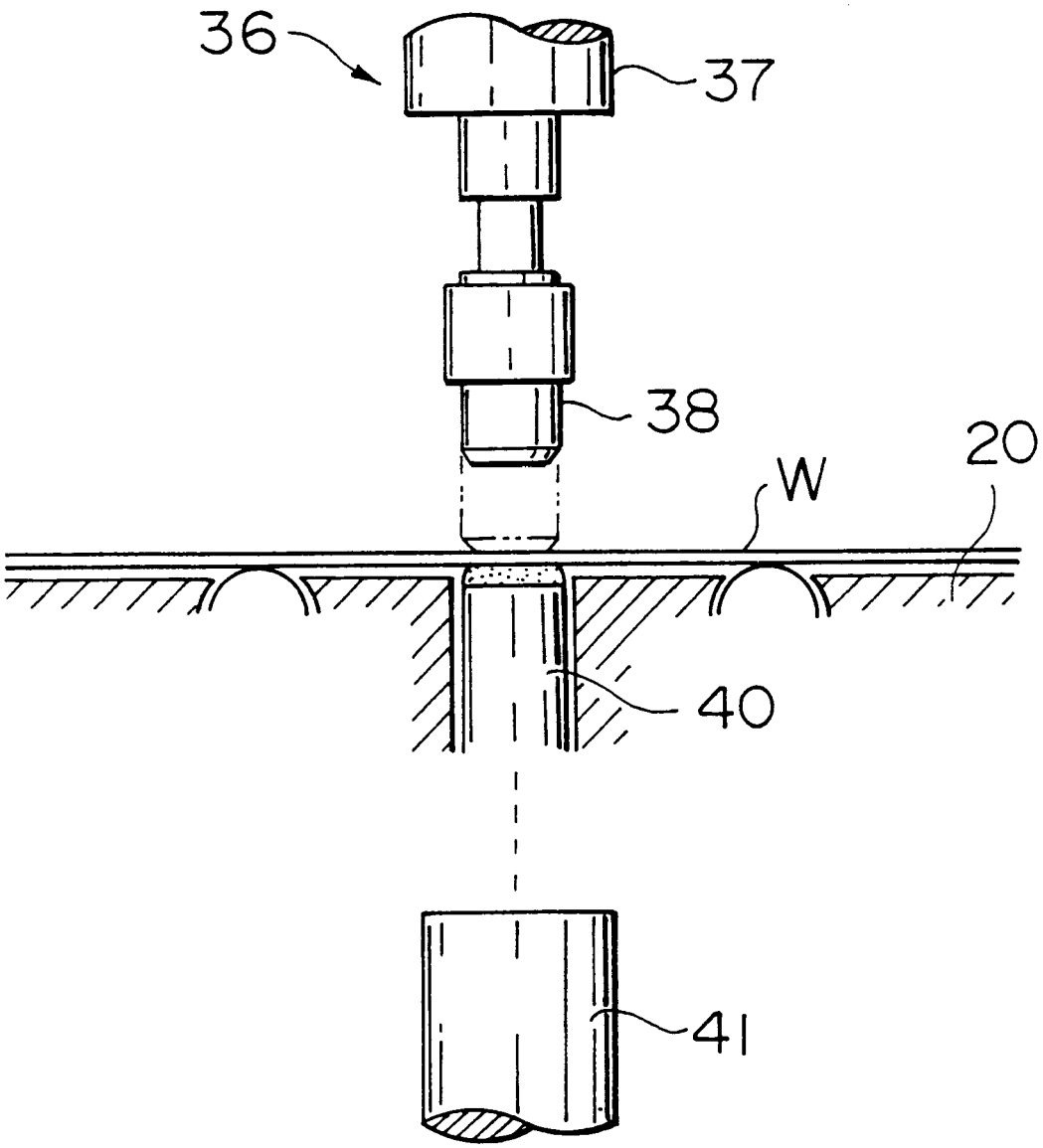
FIG. 16 is a cross-sectional view of an upper and lower friction pad installation portion according to a fourth embodiment of the present invention.

The remaining part of the configuration of the second and fourth embodiments in FIGS. 9 and 16, respectively, are the same as in the first embodiment.

In this embodiment, both the press molds 4, penetrating the plate workpiece W, and also the friction pads 38, pressing the plate workpiece W against the workpiece table 20, operate as position restricting members for the plate workpiece W. Therefore, the plate workpiece W is more reliably prevented from becoming offset when it is released from the workpiece holder 23. After the repositioning operation, the friction pads 38 are elevated and saved as the press molds 4 are elevated.

Figure 14:
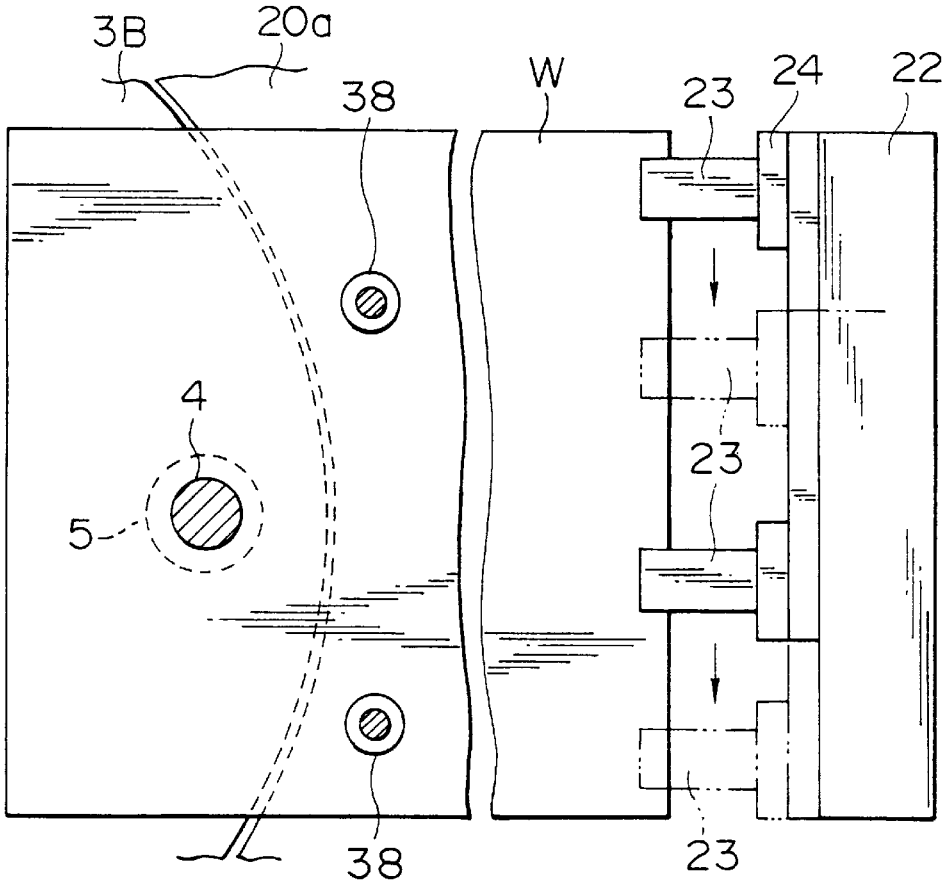
FIG. 14 is a plan view showing another example of the workpiece repositioning operation with respect to the second embodiment of the present invention.

In the second embodiment, which includes the friction pads 38 as an additional workpiece position restricting member, the press molds 4 are not limited to those having a horizontal cross-section other than a perfect circle, but may have a perfectly circular horizontal cross-section as shown in FIG. 14. In this case, the press molds 4 and the friction pads 31 can also reliably prevent the plate workpiece W from becoming horizontally and rotationally offset. Since the press molds 4, with a horizontal cross-section other than a perfect circle, need not be indexed for a repositioning operation as described above, currently indexed press molds 4 can be used to perform a repositioning operation, thereby preventing unnecessary increases in the cycle time.

Figure 15:
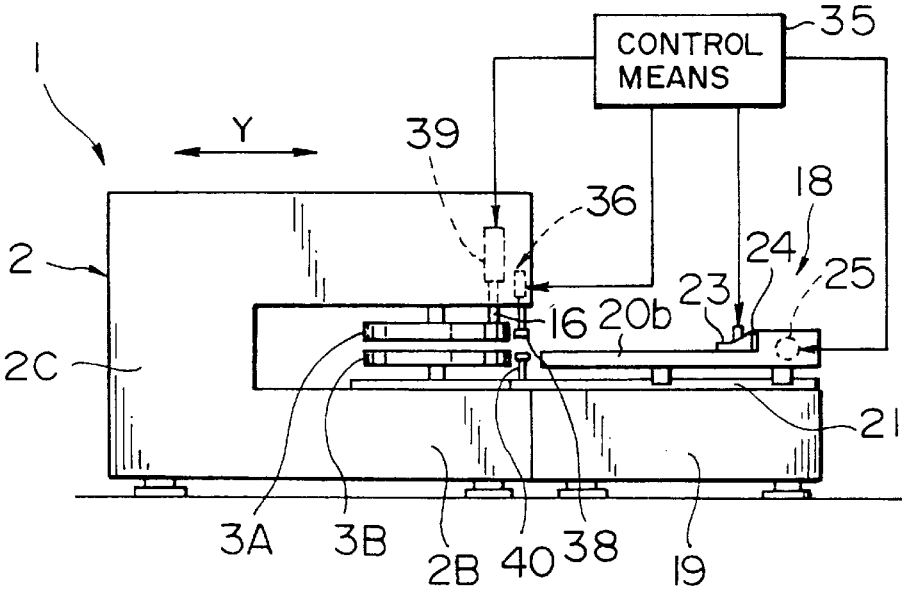
FIG. 15 is a conceptual drawing of a press machine according to a third embodiment.

Although each of the above-mentioned embodiments have been described in conjunction with the press machine 1 that uses the servo-motor 7 as the driving source of the punch driving device 6, any punch driving device that enables the ram 16 to be stopped at an arbitrary position may be used. For example, the present invention is applicable to a press machine 1 that uses a hydraulic cylinder 39 as the driving source of the punch driving device 6, as shown in the third embodiment of FIG. 15. In addition, the punch driving device may be a combination of a driving source such as a servo-motor and a toggle mechanism. Since, even in such configurations, the punch driving device 6 can be stopped easily while the press molds 4 are penetrating the plate workpiece W, the offset of the plate workpiece W can be reliably restricted to allow the workpiece holder 24 to perform a repositioning operation.

The press machine according to the present invention comprises: a workpiece gripping section for gripping and moving a workpiece on a table, wherein the workpiece gripping section is capable of a repositioning operation in which the workpiece is repositioned; a punch tool for punching a hole in the workpiece; and a control means for stopping the punch tool while it is penetrating the workpiece during a punching operation and causing the workpiece gripping section to perform a repositioning operation in this stopped condition. This configuration can reliably prevent the workpiece from becoming offset during a repositioning operation. In addition, position restricting members, such as pads, need not be provided, ensuring a simpler configuration.

According to another embodiment of the present invention, during a repositioning operation, the control means may select a punch tool with a shape other than a perfect circle to fix the workpiece. This configuration restricts not only the horizontal offset of the workpiece, but also its rotational offset around the punch tool, thereby more reliably preventing the workpiece from becoming offset during a repositioning operation.

According to another embodiment of the present invention, the apparatus includes friction pads for pressing the workpiece against the table, and the workpiece is fixed using the punch tool that penetrates the workpiece and the friction pads. This configuration allows not only the punch tool to penetrate the workpiece, but also the friction pads to restrict the position of the workpiece, thereby more reliably preventing the workpiece from becoming offset during a repositioning operation.

I claim:

1. A press machine comprising:

a workpiece gripping means for gripping a workpiece during a repositioning operation in which said workpiece is repositioned;

a punch tool for punching a hole in said workpiece, wherein said punch tool is left in a stopped condition so as to be penetrating said workpiece, while said workpiece gripping means is detached from said workpiece and then re-grips said workpiece in a different position; and a control means for stopping said punch tool while said punch tool in said stopped condition and while said punch tool is penetrating said workpiece during said repositioning operation, causing said workpiece gripping means to be detached from said workpiece and repositioned with respect to said workpiece while said punch tool is in said stopped condition so that when said punch tool is raised, said workpiece may be repositioned with respect to said punch tool so that another hole may be punched through said workpiece.

2. The press machine according to claim 1, wherein during a portion of said repositioning operation, said control means selects said punch tool so as to have a shape other than a perfect circle in order to position of said workpiece in a fixed condition between said workpiece and a table of said press machine.

3. The press machine according to claim 1, further comprising a table and friction pads for pressing said workpiece against said table, wherein said workpiece is placed in a fixed condition between said punch tool, when said punch tool is in said stopped condition so as to be penetrating said workpiece, and said friction pads.

* * * * *